US006821697B2

(12) United States Patent
Takayanagi et al.

(10) Patent No.: US 6,821,697 B2
(45) Date of Patent: Nov. 23, 2004

(54) TONER FOR ELECTROSTATIC IMAGE DEVELOPMENT AND METHOD OF PRODUCING THE SAME

(75) Inventors: Hitoshi Takayanagi, Omiya (JP); Takashi Ito, Tokyo (JP); Kenichi Hirabayashi, Kitaadachi-gun (JP); Toyomi Hashizume, Ichihara (JP)

(73) Assignee: Dainippon Ink and Chemicals, Inc., Tokyo (JP)

( * ) Notice: Subject to any disclaimer, the term of this patent is extended or adjusted under 35 U.S.C. 154(b) by 0 days.

(21) Appl. No.: 09/791,860

(22) Filed: Feb. 26, 2001

(65) Prior Publication Data

US 2002/0051923 A1 May 2, 2002

(30) Foreign Application Priority Data

Sep. 4, 2000 (JP) ..... 2000-267767

(51) Int. Cl.[7] ..... G03G 9/087

(52) U.S. Cl. ..... 430/108.4; 430/109.4; 430/110.3; 430/111.4; 430/137.14; 430/137.19

(58) Field of Search ..... 430/109.4, 111.4, 430/110.3, 108.4, 120, 124, 137.14, 137.19

(56) References Cited

U.S. PATENT DOCUMENTS

| | | | | |
|---|---|---|---|---|
| 5,079,123 A | * | 1/1992 | Nanya et al. | 430/109.4 |
| 6,077,635 A | * | 6/2000 | Okado et al. | 430/110.3 |
| 6,100,000 A | | 8/2000 | Anno et al. | |
| 6,221,549 B1 | * | 4/2001 | Emoto et al. | 430/120 |
| 6,248,491 B1 | * | 6/2001 | Takayanagi et al. | 430/109.4 |
| 6,335,139 B1 | * | 1/2002 | Gambayashi et al. | 430/111.4 |

FOREIGN PATENT DOCUMENTS

| | | |
|---|---|---|
| EP | 0 992 859 A2 | 4/2000 |
| JP | 04097366 A | 3/1992 |
| JP | 04362956 A | 12/1992 |
| JP | 11044969 A | 2/1999 |
| JP | 11190913 A | 7/1999 |

OTHER PUBLICATIONS

Diamond, A.S. ed, Handbook of Imaging Materials, Marcel Dekker, Inc., NY (1991), p. 169, 1991.*

Whelan, T., Consultant, *Polymer Technology Dictionary*, Chapman & Hall, Great Britain (1994), p. 12,.*

Database WPI; Derwent Publications LTD., XP002237244, Jul. 13, 1999 abstract of JP 11–190913.

* cited by examiner

*Primary Examiner*—Janis L. Dote
(74) *Attorney, Agent, or Firm*—Armstrong, Kratz, Quintos, Hanson & Brooks, LLP

(57) ABSTRACT

A toner for electrostatic image development made of a polyester resin having a spherical or generally spherical shape, which allows the use of a so-called oilless fixation system capable of fixing, without employing an anti-offset solution as a heat roller fixation system, and which also provides a developed image having excellent quality. The toner comprises a binder resin and a colorant. The flow beginning temperature Tfb of the toner is 90° C. or higher and 120° C. or lower, the T1/2 temperature exceeds 120° C. and is 160° C. or lower, and the flow ending temperature T end is 130° C. or higher and 170° C. or lower. The toner has a spherical or generally spherical shape having an average roundness of 0.97 or more. The toner can be produced by phase inversion at a low shear within a range of 0.2–5 m/second employing an added alcohol solvent.

20 Claims, 1 Drawing Sheet

TONER FOR ELECTROSTATIC IMAGE DEVELOPMENT AND METHOD OF PRODUCING THE SAME

BACKGROUND OF THE INVENTION

1. Field of the Invention

The present invention relates to a toner for electrostatic image development which is preferably employed in electrophotographic copying machines, printers, and facsimiles, and is also employed in TONER JET type printers.

2. Description of the Related Art

In electrophotographic copying machines, printers, and facsimiles, the following needs for the toner have recently been enhanced for cost reduction and size reduction of the machines as well as power saving and resource saving, including a further improvement in the quality of the printed image. The needs include:

(1) improvement in the definition and gradation of the printed image, reduction in the thickness of the toner layer, reduction in the amount of wasted toner, reduction in the particle diameter and spheroidizing of the toner for reducing the amount of the toner consumed per page,
(2) decrease in the fixation temperature for reduction in power consumed,
(3) oilless fixation for simplification of the machines;
(4) improvement in the hue, transparency and gloss in full-color images,
(5) reduction in VOCs (volatile organic compounds) during fixation which are likely to exert an adverse effect on human health and the like.

A reduction in the particle diameter of the powdered toner prepared by a pulverization method, which has been employed for a long time, can be basically carried out. However, with the reduction in particle size, the following problems arise: (1) it becomes difficult to control the charge because of an increase in the amount of colorants and waxes exposed on the surface of the toner particles, (2) the fluidity of the powder is lowered by the unfixed shape of the toner particles, and (3) the energy cost required for production increases, thus, in actuality, it is difficult to sufficiently satisfy the needs described above using a toner having an unfixed shape prepared by employing the pulverization method.

Therefore, development of a spherical toner having a small particle diameter has been intensively carried out by the polymerization method or the emulsification/dispersion method. Although various methods are known for producing a toner employing the polymerization method, the suspension polymerization method has been widely employed which comprises: uniformly dissolving and dispersing a monomer, a polymerization initiator, a colorant, and a charge control agent; adding the mixture to an aqueous medium containing a dispersion stabilizer while stirring to form oil droplets; and heating, thereby causing the polymerization reaction to produce toner particles. Although the reduction in particle diameter and spheroidizing can be satisfactorily conducted by the polymerization method, a principal component of the binder resin is limited to a radically-polymerizable vinyl polymer, and toner particles made of a polyester resin or epoxy resin suited for use as a color toner cannot be produced by the polymerization method. It is difficult to reduce VOCs (volatile organic compounds made of an unreacted monomer) by the polymerization method, and improvements are required.

As is disclosed in Japanese Unexamined Patent Application, First Publication No. Hei 5-66600 and Japanese Unexamined Patent Application, First Publication No. Hei 8-211655, the method of producing a toner employing the emulsification/dispersion method comprises mixing a mixture of a binder resin and a colorant with an aqueous medium and emulsifying them to obtain toner particles, and has the following advantages: (1) possible binder resins can be widely selected, (2) the reduction of VOCs is easy to realize, and (3) the concentration of the colorant is easy to change optionally within a range of low to high values, as compared with the polymerization method, in addition to the advantage that it is easy to cope with the reduction in particle diameter and spheroidizing of the toner similar to the polymerization method.

It is generally known that a polyester resin is more preferable than a styrene-acrylic resin as a binder resin for toner, which can reduce the fixing temperature and forms a smooth image surface by melting rapidly during fixation, and a polyester resin having e:xcellent pliability is particularly preferably employed in the color toner.

As described above, toner particles containing a polyester resin as the principal component cannot be produced by the polymerization method as described above. Therefore, a spherical or generally spherical toner having a small particle diameter containing a polyester resin as the binder resin obtained by the emulsification/dispersion method has attracted special interest recently.

However, in the spherical toner obtained by the emulsification/dispersion method, reduction of the fixation temperature and widening of the anti-offset temperature range are not necessarily sufficiently realized. Therefore, a fixing drum is coated with silicone oil to prevent the toner from adhering to the fixing drum during fixation. An improvement in the thermal properties of the spherical toner makes it possible to obtain an oilless toner having high anti-offset properties while utilizing its high image quality.

Techniques are disclosed in Japanese Unexamined Patent Application, First Publication Nos. Hei 9-311502, Hei 5-66600, Hei 8-211655, Hei 6-332224, Hei 6-332225, and Hei 10-319639 as methods for producing a toner containing a polyester resin as a binder resin, for example. However, not all of the problems to be solved by the present invention can be solved using these methods.

Japanese Unexamined Patent Application, First Publication No. Hei 5-66600 discloses a method of providing a mixture of a binder resin, a colorant, and an organic solvent having self-water dispersibility and/or water solubility by neutralizing the binder resin, thereby dispersing the mixture in an aqueous medium. However, this technique is intended exclusively for a styrene-acrylic resin as the binder resin and is not necessarily suited for fixation at low temperatures and a color toner. Furthermore, the publication does not make any reference to the composition of the binder resin in the toner employing a polyester resin which makes fixation at low temperatures and oilless fixation possible.

Japanese Unexamined Patent Application, First Publication Nos. Hei 6-332224 and Hei 6-332225 each disclose a method of dispersing a mixture of a polyester resin, a colorant, an organic solvent and a specific dispersion stabilizer in an aqueous medium. According to this technique, the polyester resin is dispersed in the aqueous medium by only an action of the dispersion stabilizer because the polyester resin itself has no self-water dispersibility. According to the system of dispersing employing the dispersion stabilizer, dispersion is hardly performed at low shear, and, therefore, dispersion must be performed at high shear employing a homomixer or the like. As a result, coarse particles and microparticles tend to occur, resulting in large classification loss. This publication does not make any reference to a composition which can provide the fixation at low temperatures and oilless fixation. A toner containing a high-molecular weight component or a tetrahydrofuran-insoluble fraction has a wide particle size distribution, and, therefore, there is a limit in manufacturing.

Japanese Unexamined Patent Application, First Publication No. Hei 9-311502 discloses a method of mechanically dispersing a mixture of a polyester resin and a colorant in an aqueous medium by reducing the viscosity due to melting with heating without employing a solvent. According to this method, there is a limit in molecular weight of a usable resin and those containing a large amount of a high-molecular weight component result in the breakage of the molecular chain, thus making it impossible to raise the hot offset temperature. As a result, it is impossible to attain a good fixing range in the oilless fixation system, which is the problem to be solved by the present invention.

Japanese Unexamined Patent Application, First Publication No. Hei 8-211655 discloses a method of providing a mixture of a polyester resin, a colorant, and an organic solvent having self-water dispersibility and/or water solubility by neutralization, thereby dispersing the mixture in an aqueous medium. This technique can be employed in a color toner and allows the provision of a spherical toner having a small particle diameter so that a part of the problem to be solved by the present invention can be solved. However, this publication does not make any reference to a composition which can attain fixation at low temperatures and a good fixation range in the oilless fixation system.

A polyester resin toner obtained by the emulsification/dispersion method which has hitherto been employed mainly contains a straight-chain resin having a comparatively low molecular weight as the binder resin. Therefore, it is essential to coat a fixing heat roller with an anti-offset solution such as silicone oil. Thus, the fixation in this method cannot be oilless fixation. Moreover, even if oilless fixation is employed in the above method, there are problems in that due to transfer of the silicone oil to a printing paper or an OHP sheet, it is difficult to write on the paper or sheet after printing, or the paper or sheet becomes greasy with the oil, in addition to the problem of maintenance. There is also a problem in that the peel. strength is not necessarily sufficient since it varies depending on the purposes. There is also a problem such as large emulsification loss and classification loss due to a poor particle size distribution.

BRIEF SUMMARY OF THE INVENTION

The present invention has been made in light of the circumstances described above, and an object of the present invention is to provide a toner for electrostatic image development made of a polyester resin having a spherical or generally spherical shape, which allows the use of a so-called oilless fixation system capable of fixing in a good fixing range, without employing an anti-offset solution, as a heat roller fixation system, and which also provides a developed image having excellent quality, and a method of producing the same.

Another object of the present invention is to provide an image forming method employing the toner for electrostatic image development, which solves the problems described above.

Still another object of the present invention is to provide a method of producing the toner for electrostatic image development which solves the problems described above.

The present inventors have directed their attention to the flow tester values of the toner, namely, the flow beginning temperature Tfb as measured by a constant load extrusion type capillary rheometer, the T1/2 temperature, and the flow ending temperature Tend. Thus, as a result of diligent research, the present inventors have found that a good fixation initiation temperature and anti-hot offset properties are obtained in the oilless fixation system by controlling the above-mentioned temperatures within a specific range, thus completing the present invention.

That is, the present invention provides a toner for electrostatic image development, comprising at least a binder resin and a colorant, said binder resin being made of a polyester resin, wherein the flow beginning temperature Tfb of the toner, as measured by a constant load extrusion type capillary rheometer, is 90° C. or higher and 120° C. or lower, the T1/2 temperature exceeds 120° C. and is 160° C. or lower, and the flow ending temperature Tend is 130° C. or higher and 170° C. or lower, and wherein said toner has a spherical or generally spherical shape having an average roundness (the average value of roundness is defined by (the perimeter of a circle having the same area as that of a projected area of the particles)/(the perimeter of a projected image of the particles)) of 0.97 or more.

Since the flow tester values of a spherical or generally spherical toner containing a polyester resin as a binder resin are controlled within a specific range, the toner for electrostatic image development of the present invention has a good fixation initiation temperature and anti-hot offset temperature for use with an oilless fixation heat roller. The toner for electrostatic image development of the present invention is superior in the fluidity of the powder, transfer efficiency, definition, and gradation as a result of spheroidizing and reduction in the particle diameter, thus making it possible to provide a developed image having excellent quality.

BRIEF DESCRIPTION OF THE SEVERAL VIEWS OF THE DRAWING

FIGS. 1A and 1B are schematic drawings for explaining how to determine flow tester values, in which FIG. 1A is a side sectional view showing an outline of a measuring device and FIG. 1B is a graph for explaining a method of determining each of the flow tester values from the measured values.

DETAILED DESCRIPTION OF THE INVENTION

Figure 1A:
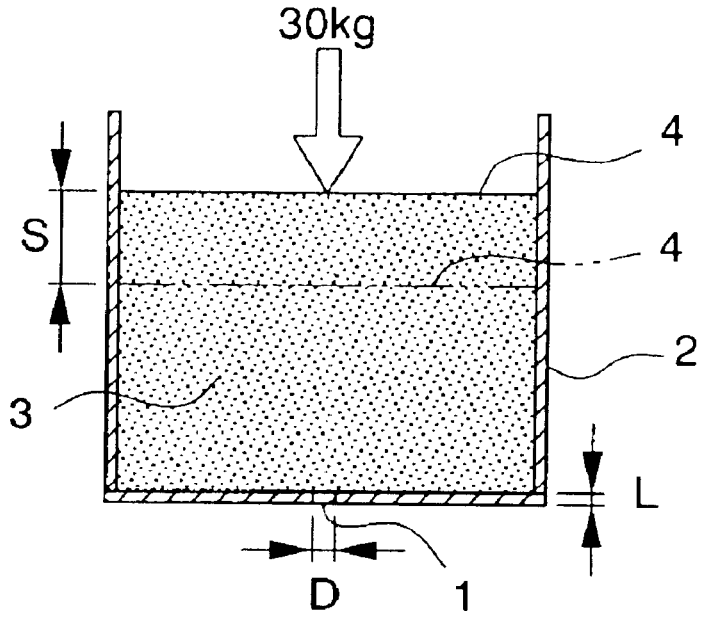

The present invention will now be described in detail.

The toner for electrostatic image development of the present invention comprises at least a binder resin and a colorant, the binder resin being made of a polyester resin. The polyester resin employed is synthesized by dehydration condensation of a polybasic acid and a polyhydric alcohol.

Examples of the polybasic acid include: aromatic carboxylic acids such as terephthalic acid, isophthalic acid, phthalic anhydride, trimellitic anhydride, pyromellitic acid, and naphthalenedicarboxylic acid; aliphatic carboxylic acids such as maleic anhydride, fumaric acid, succinic acid, alkenylsuccinic anhydride, and adipic acid; and alicyclic carboxylic acids such as cyclohexanedicarboxylic acid. These polybasic acids can be used alone or in combination. Among these polybasic acids, an aromatic carboxylic acid is preferably employed.

Examples of the polyhydric alcohol include aliphatic diols such as ethylene glycol, diethylene glycol, triethylene glycol, propylene glycol, butanediol, hexanediol, neopentyl glycol, and glycerin; alicyclic diols such as cyclohexanediol, cyclohexanedimethanol, and hydrogenated bisphenol A; and aromatic diols such as an ethylene oxide adduct of bisphenol A and a propylene oxide adduct of bisphenol A. These polyhydric alcohols can be used alone or in combination. Among these polyhydric alcohols, aromatic diols and alicyclic diols are preferred, and aromatic diols are more preferred.

A hydroxyl group at a polymer terminal and/or a carboxyl group may be esterified by further adding monocarboxylic acid and/or monoalcohol to the polyester resin obtained by the polycondensation of the polyhydric carboxylic acid and polyhydric alcohol, thereby controlling the acid value of the polyester resin.

Examples of the monocarboxylic acid employed for this purpose include acetic acid, acetic anhydride, benzoic acid, trichloroacetic acid, trifluoroacetic acid, propionic anhydride, and the like. Examples of the monoalcohol include methanol, ethanol, propanol, octanol, 2-ethylhexanol, trifluoroethanol, trichloroethanol, hexafluoroisopropanol, phenol, and the like.

The polyester resin can be produced by the condensation reaction of the polyhydric alcohol and polyhydric carboxylic acid according to a conventional method. For example, it can be produced by charging the polyhydric alcohol and polyhydric carboxylic acid in a reaction vessel equipped with a thermometer, a stirrer, and a dropping condenser; heating them to 150–250° C. in the presence of an inert gas (e.g. nitrogen gas); continuously removing a low-molecular weight compound out of the reaction system; terminating the reaction at a point of time when the acid value reaches a predetermined value; and cooling to obtain a desired reaction product.

In the synthesis of the polyester resin, a catalyst may be employed. Examples of the catalyst include esterification catalysts, for example, an organometallic compound (e.g. dibutyltin dilaurate and dibutyltin oxide, etc.) and metal alkoxide (e.g. tetrabutyl titanate, etc.). For the case where the carboxylic acid component is a lower alkyl ester, ester interexchange catalysts can be used, for example, a metal acetate (e.g. zinc acetate, lead acetate, magnesium acetate, etc.), a metal oxide (e.g. zinc oxide, antimony oxide, etc.) and a metal alkoxide (e.g. tetrabutyl titanate, etc.). The amount of the catalyst is preferably within a range of 0.01–1% by weight based on the total amount of the raw materials.

To produce a crosslinked polyester resin in such a polycondensation reaction, a polybasic acid having three or more carboxyl groups per molecule or an anhydride thereof and/or a polyhydric alcohol having three or more hydroxyl groups per molecule are preferably employed as essential synthetic raw materials.

Flow tester values of the toner for electrostatic image development of the present invention comprising the binder resin thus obtained as the binder resin are within the following range. With respect to the flow tester values of the toner for electrostatic image development, the flow beginning temperature Tfb, as measured by a constant load extrusion type capillary, rheometer, is 90° C. or higher and 120° C. or lower, the T1/2 temperature exceeds 120° C. and is 160° C. or lower, and the flow ending temperature Tend is 130° C. or higher and 170° C. or lower. The toner for electrostatic image development of the present invention has good fixation properties using these flow tester values.

Figure 1B:
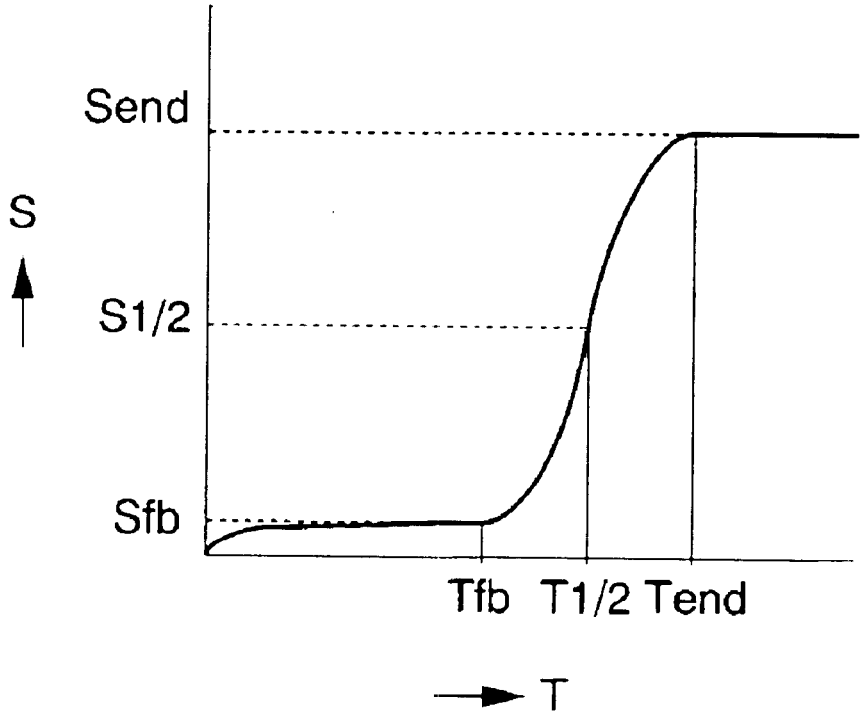

The flow beginning temperature Tfb as measured by the constant load extrusion type capillary rheometer, the T1/2temperature, and the flow ending temperature Tend are determined by employing a flow tester "CFT-500" produced by Shimadzu Corporation. Employing a flow tester as shown in FIG. 1A, a cylinder 2 equipped with a nozzle 1 having a nozzle diameter D of 1.0 mm $\phi$ and a nozzle length (depth) L of 1.0 mm is filled with a toner 3 (weight: 1.5 g) and a load per unit area ($cm^2$) of 30 kg is applied from the side opposite the nozzle 1, and, furthermore, the cylinder is heated at a heating speed of 6° C. per minute. Then, a stroke S (depression value of a loaded surface 4) of the loaded surface is measured. That is, the relationship between the increased temperature and the stroke S is determined as shown in FIG. 1B and the temperature at which the stroke 3 increases rapidly after the beginning of flowing of the toner 3 through the nozzle 1, where the curve rises, is taken as Tfb, while the temperature at which flowing of the toner 3 through the nozzle 1 is nearly completed, where the curve flattens, is taken as Tend. The temperature at S1/2, which is an intermediate value between the stroke Sfb at Tfb and the stroke Send at Tend, is taken as the T1/2 temperature.

With respect to the measurement by the heating method employing this device, the process in which the state of the sample changes from a solid region to a flow region by way of a transition region and a rubber-like elasticity region can be continuously measured by testing while increasing the temperature at a fixed rate with respect to a lapse of time during the test. The shear speed and viscosity at each temperature in the flowing region can be simply measured by employing this device.

The flow beginning temperature Tfb is an index for sharp melting properties and fixation properties at low temperatures of the toner. When the flow beginning temperature is too high, the fixation properties at low temperatures become inferior and a cold offset is liable to occur. On the other hand, when the flow beginning temperature is too low, the storage stability is lowered and a hot offset is liable to occur.

Accordingly, the flow beginning temperature Tfb of the toner for electrostatic image development is preferably 90° C. or higher and 115° C. or lower, and more preferably within a range of 90–110° C.

The melting point T1/2 measured by the "1/2 method" and the flow ending temperature Tend are indexes for anti-hot offset properties. When any of the melting point T1/2 measured by the "1/2 method" and the flow ending temperature Tend is too high, the particle size distribution becomes inferior during the formation of particles because the viscosity of the solution increases. On the other hand, when any of the melting point T1/2 measured by the "1/2 method" and the flow ending temperature Tend is too low, an offset is liable to occur, thereby lowering the practicability. Therefore, the melting point T1/2 measured by the "1/2 method" preferably exceeds 120° C. and is 155° C. or lower, and more preferably is within a range of 130–150° C., while the flow ending temperature Tend is preferably 130° C. or higher and 165° C. or lower, and more preferably 140° C. or higher and 160° C. or lower. It becomes possible to accomplish fixation within a wide temperature range by setting Tfb, T1/2, and Tend within the ranges described above.

The toner for electrostatic image development of the present invention has a spherical or generally spherical shape having an average roundness (the average value of roundness is defined by (the perimeter of a circle having the same area as that of a projected area of the particles)/(the perimeter of a projected image of the particles)) of 0.97 or more, and preferably 0.98 or more.

Since the toner for electrostatic image development of the present invention has such a spherical or generally spherical shape, it is possible to guarantee good powder fluidity even after a reduction in the particle diameter and to guarantee good transfer efficiency, thus making it possible to form an image having excellent quality (e.g. definition, gradation, etc.). When the average roundness is smaller than 0.97, that is, when the shape changes from the spherical shape toward an irregular shape, the transfer efficiency is lowered, which is not preferred. The average roundness can also be determined by taking an SEM (scanning electron microscope) photograph of the toner particles, followed by measurements and calculations, but is more easily obtained by employing a flow type particle image analyzer FPIP-1000 produced by Toa Iyo Denshi Co., Ltd. In the present invention, the average roundness was measured by this apparatus.

In such a toner for electrostatic image development, the binder resin contains a crosslinked polyester resin, and the content of a tetrahydrofuran-insoluble fraction of the binder resin in the toner is within a range of 0.2–20% by weight, preferably within a range of 0.5–10% by weight, and more preferably within a range of 0.5–6% by weight. When using, as the binder resin in the toner, a polyester resin wherein the content of the tetrahydrofuran-insoluble fraction is within a range of 0.2–20% by weight, good anti-hot offset properties can be guaranteed, which is preferred.

When the content is less than 0.2% by weight, the effect of improving the anti-hot offset properties becomes poor, which is not preferred. On the other hand, when the content is greater than 20% by weight, the viscosity of the solution becomes too high, and the particle size distribution becomes inferior during the formation of the particles. Furthermore, the fixation beginning temperature increases and the balance of the fixation properties becomes poor, which is not preferred.

The amount of the tetrahydrofuran-insoluble fraction is determined in the following manner. That is, 1 g of the toner is accurately weighed and completely dissolved in 40 ml of tetrahydrofuran. After 2 g of RADIOLITE (#700 produced by Showa Chemical Co., Ltd.) (diatomaceous earth) is uniformly disposed in a. funnel (diameter: 40 mm) on which KIRIYAMA FILTER PAPER (No. 3 (filter paper)) is placed, the solution is filtered and the cake is put in an aluminum petri dish. After drying at 140° C. for one hour, the dry weight is measured. Then, a value (percentage) is calculated by dividing the residual. resin amount in the dry weight by the initial toner sample amount and this value is taken as the insoluble fraction. Although additives such as pigment, wax, external additives, and the like are contained in the toner, the THF-insoluble fraction of the binder resin is calculated considering their content and whether they are soluble in THF.

The binder resin more preferably contains a straight-chain polyester resin. In the toner for electrostatic image development, the binder resin may be formed of a kind of a polyester resin, but practically it is preferable to employ a resin prepared by blending a crosslinked polyester resin having a high molecular weight and a high viscosity with a straight-chain polyester resin having a low molecular weight and a low viscosity in order to obtain a good fixation beginning temperature and anti-hot offset properties in view of the production of the resin. As used herein, the term "crosslinked polyester resin" refers to a resin containing a component which is insoluble in tetrahydrofuran, while the term "straight-chain resin" refers to a resin which contains no crosslinking agent component and is soluble in tetrahydrofuran. In the present invention, when employing a mixture of the straight-chain polyester resin and a crosslinked polyester resin as the binder resin; the mixture is preferably a mixture of a straight-chain polyester resin (A) and a crosslinked polyester resin (B), satisfying the following conditions.

That is, the mixture is preferably a mixture of:

(A) a straight-chain polyester resin in which the T1/2 temperature, as measured by the constant load extrusion type capillary rheometer, is 80° C. or higher and 120° C. or lower and the glass transition temperature Tg is 40° C. or higher and 75° C. or lower, and (B) a crosslinked polyester resin in which the T1/2 temperature, as measured by the constant load extrusion type capillary rheometer, exceeds 120° C. and is 210° C. or lower and the glass transition temperature Tg is 40° C. or higher and 75° C. or lower, and wherein a weight ratio of resin (A) to resin (B), (A)/(B), is within a range of 20/80–80/20, and wherein the mixture satisfies the relationship:

$$20^\circ\ C. \leqq T1/2(B) - T1/2(A) \leqq 120^\circ\ C.$$

where T1/2(A) and T1/2(B) respectively represent the T1/2 temperatures of resin (A) and resin (B).

Considering the properties at each temperature as measured by the constant load extrusion type capillary rheometer, the melting point T1/2(A) of resin (A) measured by the "1/2 method" is an index for imparting sharp melting properties and fixation properties at low temperatures, and T1/2(A) is preferably within a range of 80–115° C., and more preferably within a range of 90–110° C.

Resin (A) defined by these properties has a low softening temperature and sufficiently melts even for the case where the thermal energy is reduced as a result of the reduction of the temperature of a heat roller or the increasing of a processing speed in the fixation process employing the heat roller, thus exhibiting performances such as excellent cold offset and fixation properties at low temperatures.

When both of the melting point T1/2(B) of resin (B) measured by the "1/2 method" and the flow ending temperature Tend are too low, a hot offset is liable to occur. On the other hand, when both of them are too high, the particle size distribution becomes inferior during the formation of the particles, thereby lowering the productivity. Therefore, T1/2(B) is preferably within a range of 125–210° C., and more preferably within a range of 130–200° C.

Since resin (B) defined by these properties has strong rubber elasticity and a high melt viscosity, the internal cohesive force of the molten toner layer is maintained even during melting while heating in the fixation process and a hot offset rarely occurs, and the resin exhibits excellent resistance to abrasion after fixation because of its toughness.

By incorporating resin (A) and resin (B) with a good balance, a toner capable of sufficiently providing the anti-offset properties and fixation properties within a wide temperature range can be provided.

When the weight ratio of resin (A) to resin (B), (A)/(B), is too small, the fixation properties are affected. On the other hand, when the weight ratio is too large, the anti-offset offset properties are affected. Therefore, the weight ratio is preferably within a range of 20/80–80/20, and more preferably within a range of 30/70–70/30.

When the melting temperature measured by the "1/2 method" of resin (A) and that of resin (B) are T1/2(A) and T1/2(B), respectively, the following expression T1/2(A) <T1/2(B) may be established. T1/2(A)–1/2(B) is preferably within a range of 20–120° C., and more preferably within a range of 30–110° C., so as to uniformly mix during the melt-kneading without causing a problem due to a difference in viscosity between the resins in view of the trade-off between the fixation properties at low temperatures and the anti-offset properties.

The T1/2 temperature, as measured by the constant load extrusion type capillary rheometer, is a value obtained in the same manner as described previously in FIG. 1A and FIG. 1B, except that the measurement is performed with respect to the resin instead of the toner. The glass transition temperature Tg is a value measured at a heating speed of 10° C. per minute by the second-run method employing a differential scanning calorimeter "DSC-50" produced by Shimadzu Corporation in the present invention.

The glass transition temperature of the straight-chain polyester resin (A) and crosslinked polyester resin (B) is preferably 40° C. or higher and 75° C. or lower. When the glass transition temperature Tg is less than 40° C., the resulting toner tends to cause blocking (a phenomenon wherein particles of the toner agglomerate to form an agglomerate) during storage or in a developing apparatus. On the other hand, when the glass transition temperature exceeds 75° C., the fixation temperature of the toner increases, which is not preferable.

When employing, as the polyester resin which serves as the binder resin, the straight-chain polyester resin (A) and crosslinked polyester resin (B) which satisfy the relationship described above, the resulting toner has good fixation properties, which is preferred.

The toner of the present invention and the polyester resin used as the binder resin preferably satisfy the following relationship: T1/2 (toner)≧T1/2 (resin), where T1/2 (toner) and T1/2 (resin) respectively represent the T1/2 temperatures of the toner an the resin as measured by the constant load extrusion type capillary rheometer. When employing a polyester resin which satisfies the relationship, the resulting toner has better fixation properties.

As described hereinafter, when the pigment, as a component of the toner, is dispersed by the wet dispersion process of dissolving and dispersing a polyester resin in a solvent and kneading the mixture in a ball mill, molecular breakage of the binder resin (polyester resin) does not occur, thus. causing no change in the molecular weight of the binder resin. Accordingly, when employing a mixture obtained by the wet dispersion process, which contains as components, a binder resin, a wax, and an organic solvent, it is possible to satisfy the relationship: T1/2 (toner)≧T1/2 (resin).

On the other hand, properties of the binder resin are changed by breakage of a polymer chain during the melt-kneading in the toner obtained by the pulverization process so that the relationship T1/2 (toner)<T1/2 (resin) is established. Therefore, in order to obtain the oilless fixation properties as well as good fixation properties at low temperatures and anti-hot offset properties, it is preferable to satisfy the relationship T1/2 (toner)≧T1/2 (resin), as described in the present invention, in view of obtaining a good balance between the fixation properties at low temperatures and the anti-hot offset properties, as well as simplicity in the synthesis of the resin (it is not necessary to synthesize a high-viscosity resin because no breakage of the polymer chain occurs).

To obtain good fixation properties, the binder resin made of the polyester resin preferably satisfy all of the following conditions:

(1) the weight-average molecular weight is 30,000 or more, and more preferably 37,000 or more;

(2) the (weight-average molecular weight Mw)/(number-average molecular weight Mn) is 12 or more, and more preferably 15 or more;

(3) the area ratio of a component having a molecular weight of 600,000 is 0.5% or more, and more preferably 0.7% or more; and (4) the area ratio of a component having a molecular weight of 10,000 or less is within a range of 20–80%, and more preferably within a range of 30–70%, in the measurement of the molecular weight by gel permeation chromatography (GPC) of the tetrahydrofuran(THF)-soluble fraction.

In the toner according to the present invention, a high-molecular weight component having a molecular weight of 600,000 or higher is effective in guaranteeing the anti-hot offset properties. A toner in which a binder resin containing the high-molecular weight component having a molecular weight of 600,000 or more can be suitably used with a fixing device of the oilless fixation system. On the other hand, a low-molecular molecular weight component having a molecular weight of 10,000 or less is effective in lowering the melt viscosity of the toner, thereby attaining sharp melting properties and lowering the fixation initiation temperature. To obtain good fixation properties such as fixation at low temperatures and anti-hot offset properties, the binder resin preferably has such broad molecular weight distribution. In the granulation of the toner particles employing the emulsification/dispersion method, use of a low-molecular weight component is also preferable in view of reduction in viscosity of the resin solution.

The molecular weight of the THF-soluble fraction in the binder resin is determined in the following manner. That is, the THF-soluble fraction is collected by filtering through a filter (0.2 $\mu$m) and measured in a THF solvent (flow rate: 0.6 ml/min, temperature: 40° C.) employing GPC•HLC-8120 (gel permeation chromatography) produced by Tosoh Corporation and three columns "TSK GEL SUPER HM-M" (15 cm) produced by Tosoh Corporation, and then the molecular weight calculated by employing a molecular weight calibration curve made using a monodisperse polystyrene standard sample.

In the present invention, the molecular weight in the specific range described above of the tetrahydrofuran-insoluble fraction and tetrahydrofuran-soluble fraction belongs to the polyester resin in the toner, but not to the polyester resin as a raw material employed in the production of the toner. That is, for the case when the properties of the resin to be exerted on the fixation properties are defined, the properties of the binder resin in the toner are important.

The acid value (mg of KOH required to neutralize 1 g of a resin) of the polyester resin is preferably within a range of 1–30 KOHmg/g because (1) the above molecular weight distribution is easily obtained, (2) the formation properties of the toner particles by means of the emulsification/dispersion method are easily guaranteed, and (3) good environmental stability (stability of charge properties when the temperature and humidity change) of the resulting toner is easily retained. The acid value of the polyester resin can be adjusted by controlling a carboxyl group at a terminal of the polyester resin by means of the blend ratio and reaction rate of the polybasic acid and polyhydric alcohol as the raw materials, in addition to the addition of the monocarboxylic acid and/or the monoalcohol to the polyester resin obtained by the polycondensation between the polyhydric carboxylic acid and the polyhydric alcohol, as described above. Alternatively, a polyester having a carboxyl group in the principal chain can be obtained by employing trimellitic anhydride as the polybasic acid component.

The toner for electrostatic image development of the present invention preferably contains a releasing agent. For this case, waxes selected from the group consisting of hydrocarbon waxes such as polypropylene wax, polyethylene wax, and Fischer-Tropsch wax; synthetic ester waxes; and natural ester waxes such as carnauba wax and rice wax are employed. Among these waxes, natural waxes such as carnauba wax and rice wax, and synthetic ester waxes such as WEP-5 (produced by NOF Corporation) obtained from a polyhydric alcohol and a long- chain monocarboxylic acid are preferred.

The melting point of the wax is not specifically limited, but is preferably 150° C. or lower in view of the anti-offset properties. In view of the fixation properties and storage stability, the melting point is preferably within a range of 50–120° C. The solid wax may be used as it is, or the wax may be used in the state of an emulsion. The wax is preferably dispersed in the toner and is preferably dispersed with an average particle diameter of 3 $\mu$m or less, and more preferably 1 $\mu$m or less. The amount of the wax is preferably within a range of 1–40% by weight based on the toner. When the amount is less than 1% by weight, the releasability is liable to be insufficient. On the other hand, when the amount exceeds 40% by weight, the wax is liable to be exposed on the surface of the toner particles, thereby lowering the charge properties and storage stability.

The toner of the present invention preferably contains a positive charge control agent. The positive charge control agent is not specifically limited, and known positive charge control agents, which have conventionally been employed for toner, such as nigrosine dye, quaternary ammonium compound, onium compound, triphenylmethane compound and the like may be employed. A compound having a basic group, such as an amino group, imino group, N-hetero ring or the like, for example, a tertiary amino group-containing styrene-acrylic resin, also serves as a positive charge control agent, and can be used alone or in combination with the above other positive charge control agent. Depending on the purpose, a small amount of a negative charge control agent, such as an azo dye metal complex, salicylic acid derivative metal complex or the like, can be used in combination with these positive charge control agents.

The amount of the positive charge control agent in the toner of the present invention is preferably within a range of about 0.01–10% by weight, and particularly preferably within a range of about 0.1–6% by weight. In a production method in which a toner is produced which contains the positive charge control agent, a portion of which is exposed on the toner surface, the amount described above is required. In case the positive charge control agent is fixed on the surface of the toner particles by various means, the amount of the positive charge control agent to be added to the toner surface can be reduced. In this case, the amount is preferably within a range of 0.01–1%, and particularly preferably within a range of 0.01–0.5%. It is more preferable to fix the positive charge control agent on the surface of the toner particles because the desired proper charging is obtained by employing a small amount of the positive charge control agent.

The colorant employed in the toner for electrostatic image development of the present invention is not specifically limited, and conventionally known colorants can be employed. A pigment is preferably employed.

Examples of black pigment include Carbon Black, Cyanine Black, Aniline Black, Ferrite, Magnetite, and the like. Alternatively, black pigments prepared from the following color pigments can be used.

Examples of yellow pigment include chrome yellow, zinc yellow, cadmium yellow, yellow iron oxide, ocher, titanium yellow, NAPHTHOL YELLOW S, HANSA YELLOW 10G, HANSA YELLOW 5G, HANSA YELLOW G, HANSA YELLOW GR, HANSA YELLOW A, HANSA YELLOW RN, HANSA YELLOW R, PIGMENT YELLOW L, benzidine yellow, BENZIDINE YELLOW G, BENZIDINE YELLOW GR, PERMANENT YELLOW NCG, VULCAN FAST YELLOW 5G, VULCAN FAST YELLOW R, quinoline yellow lake, ANTHRAGEN YELLOW 6GL, PERMANENT YELLOW FGL, PERMANENT YELLOW H10G, PERMANENT YELLOW HR, anthrapyrimidine yellow, isoindolinone yellow, cromophthal yellow, NOBOPALM YELLOW H2G, Condensed Azo Yellow, Nickel Azo Yellow, copper azomethin yellow, and the like.

Examples of red pigment include chrome orange, molybdenum orange, PERMANENT ORANGE GTR, pyrazolone orange, VALCAN ORANGE, INDATHRENE BRILLIANT ORANGE RK, INDATHRENE BRILLIANT ORANGE G, BENZIDINE ORANGE G, PERMANENT RED 4R, PERMAENT RED BL, PERMANENT RED F5RK, LITHOL RED, PYRAZOLONE RED, WATCHUNG RED, LAKE RED C, LAKE RED D, BRILLIANT CARMINE 6B, BRILLIANT CARMINE 3B, RHODAMINE LAKE B, arisaline lake, PERMANENT CARMINE FBB, perinone orange, isoindolinone orange, anthanthrone orange, pyranthrone orange, quinacridone red, quinacridone magenta, quinacridone scarlet, perylene red, and the like.

Examples of blue pigment include cobalt blue, cerulean blue, alkaline blue lake, peacock blue lake, PHANATONE BLUE 6G, VICTORIA BLUE LAKE, metal-free phthalocyanine blue, copper phthalocyanine blue, FAST SKY BLUE, INDANTHRENE BLUE RS, INDANTHRENE BLUE BC, indigo, and the like.

The amount of the colorant is preferably within a range of 1–50 parts by weight, and particularly preferably within a range of 3–15 parts by weight, based on 100 parts by weight of the binder resin.

To retain good friction charge properties even when the particle diameter of the toner is reduced, it is effective to prevent the colorant from being exposed on the surface of the toner particles, that is, to attain a toner structure wherein the colorant is included in the toner particles. The impairment of the charge properties accompanying the reduction in particle diameter of the toner is also caused by the fact that the colorant and other additives (e.g. wax, etc.) are partially exposed on the surface of the toner particles. Even if the content (% by weight) of the colorant is the same, the surface area of the toner particles is increased by the reduction in particle diameter and the proportion of the colorant, wax or the like to be exposed on the surface of the toner particles is increased. As a result, the composition of the surface of the toner particles drastically changes and the friction charge properties of the toner particles drastically change, thereby making it difficult to obtain proper charge properties.

According to the toner of the present invention and method of producing the same, since the colorant and wax are included in the binder resin, the charge properties are made uniform, thereby making it possible to easily obtain a good printed image. It can be easily determined, for example, by observing the cross section of the particles employing a TEM (transmission electron microscope) that the colorant and wax are not exposed on the surface of the toner particles. More concretely, when the cross section, which was obtained by embedding the toner particles into a resin and cutting the resulting sample by a microtome, is optionally dyed with ruthenium tetraoxide and observed by a TEM, it can be confirmed that the pigment and wax are included in the binder resin and dispersed in the particles almost uniformly.

The toner for electrostatic image development of the present invention can be produced by a method of mixing a mixture comprising at least a binder resin made of a polyester resin having a carboxyl group, a colorant, and a releasing agent with an aqueous medium, emulsifying and dispersing the admixture in the presence of a base to form colored particles (I) including at least the colorant and binder resin therein, separating the colored particles (I) from the liquid medium, and drying the colored particles.

The mixture made of the binder resin, colorant, and wax can be prepared by a conventionally known method and is preferably prepared by the method of mixing these raw powders and sufficiently kneading, employing any of a twin-screw extruder, a kneader, and a twin roll. Since a breakage of the high-molecular weight component of the binder resin occurs sometimes in such a melt-kneading step, it is preferable to select the raw resin after previously confirming a change in the molecular weight during the kneading of the binder resin to produce a toner comprising the binder resin having a specific range of flow tester values similar to the toner of the present invention.

A method of emulsifying the kneaded mixture in the aqueous medium by applying high-speed stirring conditions in the presence of a base can be employed as a method of mixing the kneaded mixture thus prepared with the aqueous medium and emulsifying the admixture, for example. Particularly, when employing this process, it is preferably performed under conditions of high temperature and high pressure where the binder resin is softened, thereby making it possible to inhibit the aqueous medium from boiling.

The toner for electrostatic image development of the present invention can also be produced by a method of mixing a binder resin, a colorant, and a releasing agent with an organic solvent, and kneading and dispersing the mixture employing a wet process to obtain the above mixture. In this case, the colorant and releasing agent may be kneaded and dispersed, separately, employing the wet process.

Concretely, this is a method of dissolving the binder resin in the organic solvent, adding the colorant and releasing agent, dispersing them employing a general mixing/dispersing apparatus such as DESPA (dispersion stirrer), ball mill, beads mill, sand mill, continuous beads mill or the like, to prepare a resin solution wherein the colorant and releasing agent are finely dispersed in the organic solvent, mixing the resin solution with an aqueous medium in the presence of a basic neutralizer, thereby emulsifying them, and removing the organic solvent under reduced pressure to prepare the aqueous medium (suspension) of the colored particles (I) described above. Then, the colored particles (I) are separated from the aqueous medium and dried to obtain a toner. This method is better than the above method wherein high shear is applied to the resin, because the polymer component (gel component) is not broken. The polyester resin employed to produce the toner for electrostatic image development of the present invention is a polyester resin having a carboxyl group.

The polyester resin having a carboxyl group as an acidic group becomes self-water dispersible. With respect to the resin with self-water dispersibility the hydrophilicity increases by converting the acidic group into an anion, whereby the polyester resin is dispersed in the aqueous medium (water or a liquid medium containing water as a principal component).

Examples of the base employed to neutralize the acidic group (carboxyl group) include, but are not limited to, inorganic bases such as sodium hydroxide, potassium hydroxide, and ammonia; and organic bases such as diethylamine, triethylamine, and isopropylamine.

Examples of the organic solvent employed to dissolve or disperse the binder resin, colorant, and wax (releasing agent) include hydrocarbons such as pentane, hexane, heptane, benzene, toluene, xylene, cyclohexane, and petroleum ether; halogenated hydrocarbons such as methylene chloride, chloroform, dichloroethane, dichloroethylene, trichloroethane, trichloroethylene, and carbon tetrachloride; ketones such as acetone, methyl ethyl ketone, and methyl isobutyl ketone; and esters such as ethyl acetate and butyl acetate. These solvents can be employed alone, or two or more kinds of them can be employed in combination. The organic solvent dissolves the binder resin and is preferably a solvent having comparatively low toxicity and a low boiling point, and which is easily removed in the subsequent processes. Among these organic solvents, methyl ethyl ketone is most preferable.

The method of neutralizing the acidic group (carboxyl group) of the polyester resin with the base includes, for example, (1) a method of preparing a mixture containing a colorant, a wax, and an organic solvent employing a binder resin having a previously neutralized acidic group, or (2) a method of preparing a mixture containing a binder resin having an acidic group, a colorant, a wax, and an organic solvent, and neutralizing the mixture with a base.

The method of neutralizing the acidic group of the polyester resin with a base and emulsifying the polyester resin includes, for example, (3) a method of emulsifying by adding the mixture to an aqueous medium, or (4) a method of adding an aqueous medium to the mixture. A combination of methods (2) and (4) is preferred because the particle size distribution is improved.

A method of mixing a basic neutralizer in the aqueous medium may also be employed, but a neutralization/emulsification method employing the above combination is preferred in view of the particle size distribution.

In the method of the present invention, a phase inversion agent is preferably added to a mixture containing at least a binder resin made of a polyester resin having a carboxyl group, a colorant, and a releasing agent, and mixed with an aqueous medium in the presence of a base. As used herein, the term "phase inversion agent" differs in function from the emulsifier and dispersion stabilizer described previously in the "Prior Art" section. That is, the emulsifier and dispersion stabilizer described previously in the "Prior Art" section refer to those which are adsorbed on the surface of the particles and capable of stably dispersing the particles in the aqueous medium without causing fusing and agglomeration of the formed particles.

On the other hand, the phase inversion agents employed in the method of the present invention refer to agents having a phase inversion acceleration function. That is, in the step of adding an aqueous medium (water or a liquid medium containing water as a main component) to a mixture composed of a binder resin, a colorant or the like, and an organic solvent, gradual addition of water to the continuous organic phase of the above mixture produces discontinuous water-in-oil phases. Further addition of water causes inversion of the discontinuous water-in-oil. phases to discontinuous oil-in- water phases and forms a suspension in which the above mixture is suspended as particles (droplets) in the aqueous medium. At this time, agents having a function of smoothly promoting the inversion of the water-in-oil discontinuous phase to the oil-in-water discontinuous phase are referred to as phase inversion agents.

As described above, according to the method of the present invention, particles made of a self-water dispersible resin obtained by neutralizing the resin can be formed by phase inversion. Since said particles can stably exist in the aqueous medium because neutralized functional groups in the resin exist on the surface of the particles, so-called emulsifier and dispersion stabilizers are not required.

The binder resin employed in the present invention can be dispersed in the aqueous medium without employing the phase inversion agent because the binder resin is provided with self-water dispersibility by neutralization. However, a powdered toner having the preferable average particle diameter and particle size distribution can be easily produced by employing the phase inversion agent in the binder resin made of the polyester resin which satisfies the requirements of the toner of the present invention. For example, when water is added dropwise while stirring at low shear employing methyl ethyl ketone as the solvent, the following phenomenon occurs. That is, when dispersing in water, microparticles having a particle diameter of about 1 $\mu$m are formed. Alternatively, when a trial of increasing the particle diameter is made, the viscosity increases during the phase inversion process, thus causing no phase inversion. When the dispersion and association are conducted at high shear employing a homomixer in accordance with the technique disclosed in Japanese Unexamined Patent Application, First Publication No. Hei 10-319639, spherical powdered toners having an average particle diameter suited for use as the toner can be obtained, but microparticles and coarse particles are formed as described in the "Prior Art" section, which is not preferred.

When the phase inversion agent employed in the method of the present invention is added and a resin capable of meeting the object of the present invention is employed and, moreover, stirring is conducted at low shear, it becomes possible to produce a spherical powdered toner which has an average particle diameter suited for use as the toner and a sharp particle size distribution, and which also forms a small amount of microparticles, resulting in less classification loss.

The following can be employed as the phase inversion agent in the present invention.

(i) alcohol solvent (ii) metal salt compound

Methanol, ethanol, isopropanol, n-propanol, isobutanol, n-butanol, t-butanol, sec-butanol, ethylene glycol monomethyl ether, propylene glycol monomethyl ether, ethylene glycol monomethyl ether, or the like can be employed as the alcohol solvent, for example. As a matter of course, other alcohol solvents can also be employed. Isopropanol and n-propanol, which dissolve in water and have a low boiling point are preferred. The amount of the alcohol solvent is within a range of about 10–50 parts by weight based on 100 parts by weight of the solid content of the resin, but is not limited thereto.

Conventionally known metal salt compounds can be employed as the metal salt compound, and salts with metals having two or more valences are preferred. Examples thereof include barium chloride, calcium chloride, cuprous chloride, cupric chloride, ferrous chloride, ferric chloride, and the like. The amount of the metal salt compound is within a range of about 0.01–3 parts by weight based on 100 parts by weight of the solid content of the resin, but is not limited thereto.

The method of emulsifying/dispersing the mixture of the binder resin, the colorant, the organic solvent, and the phase inversion agent in the aqueous medium is not limited to any special method.

In the method of the present invention, high shear emulsification/dispersion apparatuses and continuous emulsification/dispersion apparatuses can be employed, such as a homomixer (produced by Tokushu Kika Kogyo Co., Ltd.), SLASHER (produced by Mitsui Mining Co., Ltd.), CAVITRON (produced by Eurotec, Ltd.), MICROFLUIDIZER (produced by Mizuho Kogyo Co., Ltd.), MUNTON-GOLIN HOMOGENIZER (produced by Golin Co.), NANOMIZER (produced by Nanomizer Co., Ltd.), STATIC MIXER (produced by Noritake Company), and the like.

However, a method of adding water dropwise while stirring at low shear employing a stirrer, an anchor blade, a turbine blade FAUDLER (manufactured by Shinko Pantec Co., Ltd) blade, FULL ZONE (manufactured by Shinko Pantec Co., Ltd.) blade, MAX BLEND (manufactured by Sumitomo Heavy Industries, Ltd.) blade, a semicircular blade, or the like at a peripheral speed within a range of 0.2–5 m/second, and preferably within a range of 0.5–4 m/second, is preferred as disclosed in Japanese Unexamined Patent Application, First Publication No. Hei 9-114135.

By performing emulsification/dispersion at low shear, the formation of fine powders can be inhibited and a more preferred particle size distribution can be realized. Also poor balance of the molecular weight distribution of the toner particles and poor fixation properties at low temperatures of the toner are not caused by the formation of fine powders containing exclusively the low-molecular weight component of the polyester resin.

The toner for electrostatic image development of the present invention can be converted into a positive-charge toner by employing a positive charge control agent. An example of a method of producing the positive-charge toner is a method in which a mixture containing, as essential components, a polyester resin, a colorant, and a positive charge control agent is mixed and emulsified with an aqueous medium in the presence of a basic neutralizer to produce particles, which are separated from the liquid medium and dried.

Alternatively, the positive-charge toner can be produced by preparing a suspension of microparticles (II), which is obtained by emulsifying a mixture of a positive charge control agent and a resin capable of being provided with self-water dispersibility and/or water solubility by neutralization with an aqueous medium in the presence of a neutralizer mixing the suspension of the microparticles (II) with a suspension of the colored particles (I) prepared by another step, adding a compound having a reverse polarity as compared with the neutralizer, thereby forming the microparticles (III), wherein the microparticles (II) are deposited on the surface of the colored microparticles (I), separating the microparticles (III) from the aqueous medium, and drying the microparticles (III).

The resin, which is employed in the step of mixing a mixture containing, as essential components, a resin capable of being provided with self-water dispersibility and/or water solubility by neutralization and a positive charge control agent with an aqueous medium in the presence of a neutralizer and emulsifying the admixture to obtain a suspension of microparticles (II) containing the positive charge control agent, is not specifically limited as long as it is a resin having an acidic group or a basic group.

Examples of the functional group, which can be converted into a hydrophilic group by neutralization, include acidic groups such as a carboxyl group, a phosphoric group, a sulfonic group, a sulfuric group, and the like. Among these acidic groups, a carboxyl group is preferable. Examples of the basic group include primary, secondary and tertiary amino groups, a quaternary ammonium group, and the like. Among these basic groups, a tertiary amino group is preferable. Examples of the resin having these functional groups include a styrene resin, a (meth)acrylic resin, a polyester resin, a polyurethane resin, an epoxy resin, and the like, and a carboxyl group-containing styrene-(meth)acrylic resin or polyester resin is particularly preferably employed.

Examples of the neutralizer of the acidic group include, but are not limited to, inorganic bases such as sodium hydroxide, potassium hydroxide, lithium hydroxide, calcium hydroxide, sodium carbonate, and ammonia; and organic bases such as diethylamine, triethylamine, and isopropylamine. Examples of the basic neutralizer as a compound having a reverse polarity as compared with the acidic neutralizer include inorganic acids such as hydrochloric acid, sulfuric acid, and phosphoric acid; and organic acids such as oxalic acid, formic acid, acetic acid, succinic acid, and p-toluenesulfonic acid.

In this case, the average particle diameter of the microparticles (II) containing the positive charge control agent is preferably smaller than the particle diameter of the colored particles (I).

The average particle: diameter of the microparticles (II) is preferably within a range of about 0.1–1 $\mu$m. The content of the charge control agent in the microparticles (II) is preferably within a range of about 2–50% by weight, and more preferably within a range of 3–20% by weight.

The amount of the microparticles (II), to be added to the colored particles (I) in the step of adding the suspension of the microparticles (II) to the suspension of the colored particles (I), uniformly mixing them, and depositing the microparticles (II) on the surface of the colored particles (I), is preferably within a range of about 0.1–10% by weight, and particularly preferably within a range of 0.5–5% by weight. The deposition of the microparticles (II) comprising a carboxyl group-containing resin and a positive charge control agent on the surface of the colored particles (I) is preferably conducted by adding an aqueous acid solution having a reverse polarity as compared with that in the production process of the microparticles (II) to the mixed suspension of the colored particles (I) and microparticles (II) while stirring. In this case, the deposition with acid and salting-out are preferably employed in combination by adding a small amount of an inorganic salt such as calcium chloride to attain uniform deposition.

The colored particles, wherein the positive charge control agent is fixed on the surface, obtained in the above steps are fixed more firmly by mixing with stirring while heating (within a range of 40–80° C. depending on Tg of the resin), employing a stirrer such as HENSCHEL MIXER after drying.

With respect to the dispersion of the spherical or generally spherical colored resin particles obtained by emulsification, it is preferred that the organic solvent is removed first. Then, solid-liquid separation of the aqueous dispersion is performed by means such as filtration and the particles are dried, thus making it possible to obtain the toner particles. It is preferred that the colored resin particles obtained by employing the emulsifier or dispersion stabilizer are washed more adequately.

With respect to the dispersion of the spherical or generally spherical colored resin particles obtained by emulsification, it is preferred that the organic solvent is removed and the hydrophilicity of the particles themselves is decreased by a reverse neutralization treatment, wherein acidic and hydrophilic groups neutralized with an acid such as hydrochloric acid, sulfuric acid, phosphoric acid, acetic acid or oxalic acid on the surface of the particles are returned to an original functional group, is preferably conducted, followed by removal of water and further filtration and drying.

The drying can be conducted by employing any of conventionally known methods, and may be conducted at a temperature where the toner particles are not thermally fused or agglomerated under normal or reduced pressure. The freeze-drying method can be employed. There is also a method of simultaneously separating and drying the toner particles from the aqueous medium by employing a spray drier. A method of stirring and drying the powder under reduced pressure while heating at a temperature where the toner particles are not thermally fused or agglomerated and a method employing FLUSH JET DRYER (produced by Seisin Kigyo Co., Ltd.) capable of instantaneously drying by use of a heat-dry air flow are efficient and preferable.

For the case when the classification for removing coarse particles and microparticles to adjust the particle size distribution of the formed toner particles is required, a conventionally known method employing a commercially available general air-flow type classifying machine for toner can be conducted. In a state when the toner particles are dispersed in the liquid medium, a water slurry of the toner particles may be classified by utilizing a difference in sedimentation properties depending on the particle diameter. The removal of the coarse particles can also be conducted by filtering the water slurry of the toner particles by employing a filter or a wet vibration sieve. With respect to the particle size distribution of the toner, a ratio of 50% particle volume diameter to 50 % number particle diameter as measured by COULTER MULTISIZER (apparatus for particle size distribution measurement) is preferably 1.35 or less, and preferably 1.25 or less, because a good image is easily obtained.

The volume-average particle diameter of the spherical powdered toner for electrostatic image development of the present invention is preferably within a range of 1–13 $\mu$m in view of the resulting image quality, and is more preferably within a range of about 3–10 $\mu$m because good matching with a currently existing machine is easily obtained. In case of a color toner, the volume-average particle diameter is preferably within a range of about 3–8 $\mu$m. When the volume-average particle diameter becomes smaller, not only are the definition and gradation improved, but also, the thickness of the toner layer for forming the printed image becomes smaller, thereby producing the effect of reducing the amount of the toner to be consumed per page, which is preferable.

The powdered toner particles after drying can be employed as a developing agent as is, but properties such as fluidity and charge properties are preferably improved by adding an external additive for toner such as inorganic oxide microparticles, organic polymer microparticles or the like to the surface of the toner particles. Examples of the external additive include silica, titanium oxide, aluminum oxide, vinyl (co)polymer, and the like. These external additives are preferably added in an amount within a range of about 0.05–5% by weight based on the weight of the toner particles.

The toner of the present invention can be employed for development of an electrostatic latent image by means of the electrophotographic method, or employed as a one-component developing agent or a two-component developing agent mixed with a carrier. The carrier is not specifically limited, and conventionally known carriers such as iron powder, ferrite or magnetite, or carriers coated with a resin can be used.

The toner of the present invention can be preferably employed in a printer of a so-called TONER JET system employing method of directly spraying a powdered toner, which is frictionally charged. by employing a non-magnetic one component developing apparatus comprising a developing agent bearing roller and a layer control member, over a paper on a back surface electrode through a hole on a flexible printed board with an electrode having a function of controlling the amount of the toner to be passed in the vicinity, thereby forming an image. Since the toner of the present invention is superior in fixation properties and color properties and has a spherical shape, it becomes easy to control scattering of the toner in a TONER JET system in comparison with a toner having an unfixed shape.

EXAMPLES

The following Examples further illustrate the present invention in detail, but the present invention is not limited thereto. In the following Examples and Comparative Examples, parts are by weight and water signifies deionized water.

(Synthesis Example of polyester resin)

Employing trimellitic anhydride (TMA) as the polyhydric carboxylic acid, terephthalic acid (TPA) and isophthalic acid (IPA) as the dihydric carboxylic acid, polyoxypropylene(2, 4)-2,2-bis(4-hydroxyphenyl)propane (BPA-PO) and polyoxyethylene(2.4)-2,2-bis(4-hydroxyphenyl)propane (BPA-EO) as the aromatic diol, and ethylene glycol (EG) as the aliphatic diol in each molar ratio shown in Table 1, tetrabutyl titanate as the polymerization catalyst was charged in a separable flask in the amount of 0.3% by weight based on the total amount of monomers. The flask was equipped with a thermometer, a stirrer, a condenser, and a nitrogen introducing tube at the upper portion and the mixture was reacted in an electrically heated mantle heater at 220° C. for 15 hours in a nitrogen gas flow at normal pressure and, after gradually evacuating, the reaction was continued at 10 mmHg. The reaction was monitored by measuring the softening point in accordance with the ASTM•E28-517 standard, and the reaction was completed by terminating the evacuation when the softening point reached a predetermined temperature.

The composition and values of the physical properties (values of properties) of the resin thus synthesized are shown in Table 1 and Table 2. Table 1 is for a straight-chain polyester resin, while Table 2 is for a crosslinked polyester resin.

TABLE 1

| Resin No. | R1 | R2 | R3 |
|---|---|---|---|
| Composition of Resin | | | |
| TPA | 36.9 | 46.1 | 36.5 |
| IPA | 9.2 | | 9.1 |
| TMA | | | |
| BPA-PO | 22.5 | | 22.3 |
| BPA-EO | 11.3 | 33.8 | 11.1 |
| EG | 20.1 | 20.1 | 21.0 |
| | 100 mol/% | 100 mol/% | 100 mol/% |
| Properties of Resin | | | |
| gel fraction (% by weight) | 0 | 0 | 0 |
| T1/2 temperature (10 kg load) | 100 | 96 | 96 |
| T1/2 temperature (30 kg load) | 93 | 90 | 90 |
| acid value (KOH mg/g) | 6.7 | 6.5 | 3.7 |
| Tg (° C.) | 54 | 55 | 55 |
| Mw (THF-soluble fraction) | 5700 | 5600 | 5500 |
| Mn (THF-soluble fraction) | 2100 | 2600 | 2700 |

TABLE 2

| Resin No. | R4 | R5 | R6 |
|---|---|---|---|
| Composition of Resin | | | |
| TPA | 31.2 | 31.2 | 32.8 |
| IPA | 11.6 | 11.6 | 12.2 |
| TMA | 5.2 | 5.2 | 3.0 |
| BPA-PO | | 18.0 | 22.0 |
| BPA-EO | 24.0 | 6.0 | |
| EG | 28.0 | 28.0 | 30.0 |
| | 100 mol/% | 100 mol/% | 100 mol/% |
| Properties of Resin | | | |
| gel fraction (% by weight) | 6 | 12 | 3 |
| T1/2 temperature (10 kg load) | 163 | 168 | 153 |

TABLE 2-continued

| Resin No. | R4 | R5 | R6 |
|---|---|---|---|
| T1/2 temperature (30 kg load) | 151 | 152 | 141 |
| acid value (KOH mg/g) | 10.0 | 8.0 | 8.5 |
| Tg (° C.) | 65 | 64 | 64 |
| Mw (THF-soluble fraction) | 83000 | 110000 | 75400 |
| Mn (THF-soluble fraction) | 3200 | 3600 | 3100 |

In Table 1 and Table 2, the "T1/2 temperature" is a value measured at a nozzle diameter of 1.0 mm ϕ×1.0 mm, a load of 10 kg per unit area ($cm^2$) and a heating speed of 6° C. per minute employing a flow tester "CFT-500" produced by Shimadzu Corporation. The glass transition temperature Tg is a value measured at a heating speed of 10° C. per minute by the second-run method employing a differential scanning calorimeter "DSC-500" produced by Shimadzu Corporation.

The T1/2 temperature value, measured by the flow tester under the same conditions as described above, except that a load of 30 kg was employed, was also described.

(Preparation Example of releasing agent and releasing agent dispersion)

105 parts of a releasing agent, 45 parts of a polyester resin (R1 in Table 1), and 280 parts of methyl ethyl ketone were charged in a ball mill and, after stirring for 18 hours, the mixture was removed and the solid content was adjusted to 20% by weight to obtain releasing agent microdispersions (W1–W4). Properties of the resulting releasing agent dispersions are shown in Table 3.

TABLE 3

| Releasing Agent Dispersion | W1 | W2 | W3 | W4 |
|---|---|---|---|---|
| Releasing Agent | PP | PE | FT-100 | synthetic ester |
| Polyester resin | R1 | R1 | R1 | R1 |
| Weight Ratio of Releasing Agent to Resin | 70/30 | 70/30 | 70/30 | 70/30 |
| Endothermic Peak Temperature of Releasing Agent (° C.) | 140.1 | 130.2 | 91.1 | 84.1 |
| Solid content (% by weight) | 20 | 20 | 20 | 20 |

The releasing agents shown in Table 3 are as follows.

PP: "VISCOL 660P" (polypropylene wax produced by Sanyo Chemicals).

PE: "LICOWAX PE-130PDR" (polyethylene wax produced by Clariant).

ET-100: "LUVAX-1211" (Fischer-Tropsch wax produced by Nippon Seiro Co., Ltd.)

Synthetic ester: "WEP-5" (synthetic ester wax produced by NOF Corporation)

(Preparation Example of colorant dispersion)

A colorant, a resin, and methyl ethyl ketone were charged in a ball mill so that the solid content became 35–50%, and, after stirring for 18–36 hours, the mixture was removed and the solid content was adjusted to 20% by weight to obtain colorant dispersions (P1–P4). Properties of the resulting colorant dispersions are shown in Table 4.

TABLE 4

| Colorant Dispersion | P1 | P2 | P3 | P4 |
|---|---|---|---|---|
| Colorant Resin | Carbon R1/R4 = 40/60 | Cyan R1/R4 = 40/60 | Yellow R1/R4 = 40/60 | Magenta R1/R4 = 40/60 |
| Weight Ratio of Colorant to Resin | 50/50 | 50/50 | 20/80 | 50/50 |
| Solid Content during Dispersion (%) | 32 | 32 | 35 | 40 |
| Dispersion Time (hour) | 18 | 18 | 18 | 36 |
| Solid Content (%) | 20 | 20 | 20 | 20 |

The colorants shown in Table 4 are as follows.

carbon: "ELFTEX-8" (produced by Cabot)

Cyan: "FASTOGEN BLUE TGR" (produced by Dainippon Ink and Chemicals, Inc.)

yellow: "SYMULER FAST YELLOW 8GR" (produced by Dainippon Ink and Chemicals, Inc.)

magenta: "FASTOGEN SUPER MAGENTA R" (produced by Dainippon Ink and Chemicals, Inc.)

(Preparation of wet-kneaded mill base)

The above colorant dispersion, a resin, and methyl ethyl ketone were mixed employing DESPA and the solid content was adjusted to 55% by weight to obtain mill bases (MB1–MB13). Each formulation of the mill bases thus prepared is shown in Table 5.

TABLE 5

| Mill Base | Colorant Dispersion | Polyester Resin (I) | MEK | Solid Content |
|---|---|---|---|---|
| MB1 | P1: 100 parts | R1: 30 parts, R5: 45 parts | 15 parts | 55% |
| MB2 | P1: 100 parts | R1: 30 parts, R4: 45 parts | 15 parts | 55% |
| MB3 | P1: 100 parts | R2: 30 parts, R4: 45 parts | 15 parts | 55% |
| MB4 | P1: 100 parts | R1: 21.5 parts, R4: 53.5 parts | 15 parts | 55% |
| MB5 | P1: 100 parts | R3: 38.5 parts, R4: 36.5 parts | 15 parts | 55% |
| MB6 | P1: 100 parts | R2: 55.5 parts, R5: 19.5 parts | 15 parts | 55% |
| MB7 | P2: 40 parts | R1: 34.8 parts, R4: 52.2 parts | 63 parts | 55% |
| MB8 | P3: 75 parts | R1: 32 parts, R4: 48 parts | 35 parts | 55% |
| MB9 | P4: 50 parts | R1: 34 parts, R4: 51 parts | 55 parts | 55% |
| MB10 | P1: 100 parts | R1: 30 parts, R6: 45 parts | 15 parts | 55% |
| MB11 | P1: 100 parts | R1: 55.5 parts, 6R: 19.5 parts | 15 parts | 55% |
| MB12 | P1: 100 parts | R1: 75 parts | 15 parts | 55% |
| MB13 | P1: 100 parts | R4: 75 parts | 15 parts | 55% |

(Preparation of melt-kneaded mill base)

A resin, a colorant, and a releasing agent were premixed and kneaded in a twin-screw kneader, and then the kneaded mixture was dissolved and dispersed in methyl ethyl ketone employing DESPA and the solid content was adjusted to 55% to form mill bases. A color pigment was kneaded by a twin roll to make a master batch. Each formulation of the mill bases thus prepared is shown in Table 6.

TABLE 6

| Mill Base | Colorant | Releasing Agent | Polyester Resin (I) | MEK | Solid Content |
|---|---|---|---|---|---|
| MB14 | carbon 10 parts | carnauba 5 parts | R1: 59.5 parts R6: 25.5 parts | 200 parts | 55% |
| MB15 | carbon 10 parts | carnauba 5 parts | R1: 34 parts R4: 51 parts | 200 parts | 55% |
| MB16 | cyan/R1 4 parts/ 4 parts | carnauba 5 parts | R1: 32.4 parts R4: 54.6 parts | 200 parts | 55% |

The releasing agents and colorants shown in Table 6 are as follows.

carnauba: "CARNAUBA WAX No. 1" (product imported by Kato Yoko)

carbon: "ELFTEX-8" (produced by Cabot)

cyan: "FASTOGEN BLUE TGR" (produced by Dainippon Ink and Chemicals, Inc.)

Example 1

545.5 parts of MB2 shown in Table 5, 115 parts of W4 shown in Table 3, 57.5 parts of methyl ethyl ketone, 29.0 parts of isopropyl alcohol as the phase inversion accelerator, and 25.8 parts of an aqueous 1 N ammonia solution were charged in a cylindrical vessel, followed by sufficient stirring. Subsequently, 230 parts of water were added and the liquid temperature was raised to 30° C. Then, 44 parts of water were added dropwise while stirring, thereby performing phase inversion emulsification. The peripheral speed was 1.05 m/second. After the stirring was continued for 30 minutes, the rotation was terminated, and 400 parts of water were added.

A water slurry of particles was observed by an optical microscope. As a result, agglomerates of the releasing agent were not observed, and a flowing releasing agent was also not observed. The particle size distribution was measured by COULTER COUNTER (apparatus for particle size distribution measurement). As a result, Dv/Dn was 1.32, and the occurrence of coarse particles was not observed.

The solvent was removed by vacuum distillation, followed by filtration and washing with water. The resulting wet cake was dispersed again in water and, after controlling the pH to 4 by adding an aqueous 1 N hydrochloric acid solution, filtration and washing with water were repeated. The wet cake thus obtained was freeze-dried and then classified by an air-flow type classifying machine to obtain toner particles having a volume-average particle diameter of 7.4 $\mu$m and an average roundness of 0.983.

The resulting toner particles were embedded into a resin and the resulting sample was cut by a microtome, and then the cross section dyed with ruthenium tetraoxide was observed by a TEM (transmission electron microscope). As a result, the pigment and wax were included in the binder resin and dispersed in the particles nearly uniformly.

Employing HENSCHEL MIXER (a stirrer), 1.5 parts of a hydrophobic silica and 0.5 parts of titanium oxide were externally added to 100 parts of the resulting toner particles to obtain a powdered toner (for electrostatic image development).

Example 2

545.5 parts of MB2 shown in Table 5, 115 parts of W4 shown in Table 3, 57.5 parts of methyl ethyl ketone, 28.0 parts of isopropyl alcohol as the phase inversion accelerator, and 26.5 parts of an aqueous 1 N ammonia solution were charged in a cylindrical vessel, followed by sufficient stirring. Subsequently, 230 parts of water were added and the liquid temperature was raised to 30° C. Then, 44 parts of water were added dropwise while stirring, thereby performing phase inversion emulsification. The peripheral speed was 1.05 m/second. After the stirring was continued for 30 minutes, the rotation was terminated, and 400 parts of water were added.

A water slurry of particles was observed by an optical microscope. As a result, agglomerates of the releasing agent were not observed, and a flowing releasing agent was also not observed. The particle size distribution was measured by COULTER COUNTER (apparatus for particle size ditribution measurement). As a result, Dv/Dn was 1.35, and the occurrence of coarse particles was not observed.

The solvent was removed by vacuum distillation, followed by filtration and washing with water. The resulting wet cake was dispersed again in water and, after controlling the pH to 4 by adding an aqueous 1 N hydrochloric acid solution, filtration and washing with water were repeated. The wet cake thus obtained was freeze-dried and then classified by an air-flow type classifying machine to obtain toner particles having a volume-average particle. diameter of 5.2 μm and an average roundness of 0.981.

The resulting toner particles were embedded into a resin and the resulting sample was cut by a microtome, and then the cross section dyed with ruthenium tetraoxide was observed by a TEM (transmission electron microscope). As a result, the pigment and wax were included in the binder resin and dispersed in the particles nearly uniformly.

Employing HENSCHEL MIXER (a stirrer), 2 parts of a hydrophobic silica and 1 part of titanium oxide were externally added to 100 parts of the resulting toner particles to obtain a powdered toner (for electrostatic image development).

Comparative Example 1

51.0 parts of the resin R4 shown in Table 2, 34.0 parts of the resin R1 shown in Table 1, 5 parts of a synthetic ester WEP-5 as the releasing agent, and 10 parts of carbon black "ELFTEX-8" as the colorant were kneaded in a twin-screw extruder, and the kneaded mixture was pulverized and then classified to obtain a powdered toner (Comparative Example 1–1) having a volume-average particle diameter of 5.4 μm and a powdered toner (Comparative Example 1–2) having a volume-average particle diameter of 7.8 μm, respectively.

The resulting powdered toners were observed by a TEM (transmission electron microscope) in the same manner as those of Examples 1 and 2. As a result, the pigment and wax were partially exposed on the surface of the toner particles of Comparative Example 1–1 and Comparative Example 1–2.

(Other Examples and Comparative Examples)

The powdered toners of the other Examples and Comparative Examples were basically produced in the same manner as in Example 1, and the respective powdered toners were obtained by appropriately adjusting the amount of solvents such as methyl ethyl ketone and isopropyl alcohol as the phase inversion accelerator, the amount of water to be added dropwise, and the amount of the base.

The MB (mill base) and releasing agent used, as well as the measured value of the average roundness of the powdered toners of the respective Examples and Comparative Examples are shown in Table 7 and Table 8.

TABLE 7

| | MB Used | Releasing Agent Used | Dv (μm) | Average Roundness | Granulation Properties Dv/Dn |
|---|---|---|---|---|---|
| Example 1 | MB2 545.5 parts | W4 115 parts | 7.4 | 0.983 | 1.32 |
| Example 2 | MB2 545.5 parts | W4 115 parts | 5.2 | 0.981 | 1.35 |
| Comp. Example 1-1 | | WEP-5 | 5.4 | 0.950 | |
| Comp. Example 1-2 | | WEP-5 | 7.8 | 0.948 | |
| Example 4 | MB3 545.5 parts | W4 115 parts | 5.3 | 0.983 | 1.32 |
| Example 5 | MB4 545.5 parts | W4 115 parts | 7.5 | 0.977 | 1.42 |
| Example 6 | MB5 545.5 parts | W3 115 parts | 7.5 | 0.981 | 1.44 |
| Example 7 | MB6 545.5 parts | W4 115 parts | 7.3 | 0.985 | 1.47 |
| Example 8 | MB7 545.5 parts | W4 115 parts | 7.6 | 0.978 | 1.30 |
| Example 9 | MB8 545.5 parts | W4 115 parts | 7.3 | 0.975 | 1.33 |

TABLE 8

| | MB Used | Releasing Agent Used | Dv (μm) | Average Roundness | Granulation Properties Dv/Dn |
|---|---|---|---|---|---|
| Example 10 | MB9 545.5 parts | W4 115 parts | 7.2 | 0.976 | 1.36 |
| Example 11 | MB10 545.5 parts | W4 115 parts | 7.5 | 0.981 | 1.36 |
| Example 12 | MB2 545.5 parts | W1 115 parts | 7.6 | 0.983 | 1.47 |
| Example 13 | MB2 545.5 parts | W2 115 parts | 7.4 | 0.982 | 1.43 |
| Example 14 | MB15 545.5 parts | carnauba | 7.3 | 0.980 | 1.34 |
| Example 15 | MB16 545.5 parts | carnauba | 7.5 | 0.979 | 1.35 |
| Comp. Example 2 | MB11 545.5 parts | W4 115 parts | 7.4 | 0.983 | 1.45 |
| Comp. Example 3 | MB12 545.5 parts | W4 115 parts | 7.3 | 0.985 | 1.53 |
| Comp. Example 4 | MB13 545.5 parts | W4 115 parts | 7.4 | 0.978 | 1.51 |
| Comp. Example 5 | MB14 545.5 parts | carnauba | 7.6 | 0.983 | 1.38 |

The glass transition temperature Tg, the flow beginning temperature Tfb of the toner as measured by a constant load extrusion type capillary rheometer, the T1/2 temperature, the flow ending temperature Tend, the THF-insoluble fraction, and the fixation temperature range of the powdered toners of the respective Examples and Comparative Examples were measured, respectively. The results are shown in Table 9. Furthermore, it was determined whether the toners of the respective Examples and Comparative Examples met the relationship: T1/2 (toner)≧T1/2 (resin). The results are also shown in Table 9 (in Table 9, this is shown as T1/2 (toner)≧T1/2 (resin)).

The glass transition temperature Tg was measured at a heating speed of 10° C. per minute by the second-run method employing a differential scanning calorimeter "DSC-50" produced by Shimadzu Corporation, in the same manner as in Table 1 and Table 2. The flow beginning temperature Tfb, the T1/2 temperature, and the flow ending temperature Tend were measured by employing a flow tester "CFT-500" produced by Shimadzu Corporation, as described in FIG. 1A and FIG. 1B.

The measurements were performed under a load of 10 kg and 30 kg.

With respect to the fixation temperature range, the fixation temperature was determined by the following fixing properties test, and the fixation temperature range is indicated by the range between the upper and lower limits.

(Fixation properties test)

Employing each of the powdered toners of the Examples and Comparative Examples, the respective printed papers were fixed by passing through a heat roller (oilless type) RICOH IMAGIO DA-250 at a speed of 90 mm/second, and then cellophane tape was applied on the image after fixation. The surface temperature range of the heat roller when the ID (image density) after peeling was 90% or more of the original ID and an offset did not occur is defined as the "fixation temperature".

TABLE 9

| | Tg | 10 kg Load (° C.) | | | 30 kg Load (° C.) | | | THF-insoluble | T1/2 (T) ≧ | Fixation Temperature |
|---|---|---|---|---|---|---|---|---|---|---|
| | (° C.) | Tfb | T1/2 | Tend | Tfb | T1/2 | Tend | Fraction | T1/2 (R) | Range (° C.) |
| Example 1 | 60.0 | 117 | 149.5 | 158.5 | 104 | 136 | 145 | 3.8 | ○ | 115–210 |
| Example 2 | 59.0 | 116 | 149 | 157.5 | 103 | 136 | 144 | 3.8 | ○ | 113–210 |
| Comparative Example 1-1 | 57.0 | 110 | 130 | 137 | 101 | 122 | 130 | 0.5 | x | 123–190 |
| Comparative Example 1-2 | 56.5 | 109 | 128.5 | 137 | 101 | 121 | 130 | 0.5 | x | 121–193 |
| Example 4 | 60.0 | 116 | 148 | 158 | 104 | 135 | 145 | 3.6 | ○ | 115–210 |
| Example 5 | 62.0 | 120 | 153 | 162 | 107 | 140 | 149 | 4.4 | ○ | 126–220 |
| Example 6 | 58.0 | 110 | 147 | 158 | 99 | 134 | 145 | 3.2 | ○ | 113–200 |
| Example 7 | 56.0 | 103 | 140 | 150 | 92 | 130 | 140 | 3.5 | ○ | 110–192 |
| Example 8 | 59.0 | 115 | 148 | 158 | 103 | 135 | 145 | 3.8 | ○ | 118–205 |
| Example 9 | 59.5 | 116 | 147 | 159 | 104 | 134 | 146 | 3.6 | ○ | 118–205 |
| Example 10 | 59.5 | 117 | 149 | 159 | 104 | 136 | 146 | 3.8 | ○ | 119–205 |
| Example 11 | 60.0 | 110 | 140 | 148 | 100 | 130 | 138 | 1.5 | ○ | 112–200 |
| Example 12 | 60.5 | 117 | 148.5 | 158 | 104 | 136 | 146 | 3.8 | ○ | 125–200 |
| Example 13 | 59.5 | 116 | 149 | 158.5 | 103 | 137 | 147 | 3.7 | ○ | 120–200 |
| Example 14 | 60.5 | 107 | 130 | 138 | 99 | 122 | 130 | 0.5 | x | 119–189 |
| Example 15 | 60.0 | 108 | 130.5 | 138 | 100 | 122.5 | 130 | 0.5 | x | 119–193 |
| Comparative Example 2 | 56.0 | 105 | 118 | 128 | 98 | 110 | 120 | 0.8 | ○ | 120–160 |
| Comparative Example 3 | 54.0 | 87 | 102 | 107 | 80 | 95 | 100 | 0 | ○ | 120–130 |
| Comparative Example 4 | 66.0 | 138 | 167 | 180 | 125 | 161 | 171 | 5.7 | ○ | 150–220 |
| Comparative Example 5 | 55.0 | 98 | 118 | 123 | 91 | 111 | 115 | 0 | x | 118–160 |

It is confirmed from the results shown in Table 9 that the powdered toner of the Examples of the present invention has a good fixation initiation temperature and anti-hot offset temperature and also has a wide fixation temperature range.

The THF-soluble fractions (GPC measurement results) in the powdered toners of the respective Examples and Comparative Examples are shown in Table 10. This GPC measurement was performed in the same manner as the molecular weight measurement of the binder resin made of the above polyester resin according to the gel permeation chromatography (GPC) method.

TABLE 10

| | THF-soluble Fraction in Toner: GPC Measurement Results | | | |
|---|---|---|---|---|
| | Weight-average Molecular Weight | Mw/Mn | >600000 | <10000 |
| Example 1 | 49700 | 20.5 | 1.5 | 63.0 |
| Example 2 | 48300 | 19.8 | 1.53 | 62.5 |
| Comparative Example 1-1 | 56300 | 18.8 | 0.85 | 64.3 |
| Comparative Example 1-2 | 56500 | 18.3 | 0.85 | 64.1 |
| Example 4 | 48700 | 21.5 | 1.63 | 64.8 |
| Example 5 | 45300 | 23.1 | 2.35 | 55.0 |
| Example 6 | 45200 | 18.9 | 1.23 | 67.5 |
| Example 7 | 35600 | 17.2 | 0.5 | 78.5 |
| Example 8 | 48500 | 21.5 | 1.60 | 63.8 |
| Example 9 | 49100 | 22.3 | 1.55 | 64.3 |
| Example 10 | 48800 | 21.2 | 1.50 | 62.9 |
| Example 11 | 42200 | 18.9 | 1.15 | 65.1 |
| Example 12 | 48900 | 21.2 | 1.60 | 64.6 |
| Example 13 | 49300 | 20.6 | 1.52 | 62.8 |
| Example 14 | 52000 | 18.1 | 0.80 | 65.2 |
| Example 15 | 54500 | 17.6 | 0.75 | 65.2 |
| Comparative Example 2 | 34600 | 18.3 | 0.30 | 84.5 |
| Comparative Example 3 | 5800 | 2.7 | 0 | 100 |
| Comparative Example 4 | 88000 | 25.2 | 3.5 | 40.0 |
| Comparative Example 5 | 23000 | 7.5 | 0.3 | 84.3 |

(Image formation test)

With respect to the powdered toners of the respective Examples and Comparative Examples, the image was formed by employing a commercially available non-magnetic single-component system printer, and then the fogging, definition, gradation, OHP transparency, and transfer efficiency were evaluated, respectively.

The results are as shown in Table 11.

TABLE 11

| | Fogging | Definition | Gradation | OHP Transparency | Transfer Efficiency (%) |
|---|---|---|---|---|---|
| Example 1 | ○ | ○ | ○ | | 98 |
| Example 2 | ○ | ◎ | ◎ | | 97 |
| Comp. Example 1-1 | x | — | — | | 87 |
| Comp. Example 1-2 | standard | standard | standard | | 88 |
| Example 4 | ○ | ◎ | ◎ | | 98 |
| Example 5 | ○ | ○ | ○ | | 97 |
| Example 6 | ○ | ○ | ○ | | 98 |
| Example 7 | ○ | ○ | ○ | | 98 |
| Example 8 | ○ | ○ | ○ | ○ | 96 |
| Example 9 | ○ | ○ | ○ | ○ | 96 |
| Example 10 | ○ | ○ | ○ | ○ | 95 |
| Example 11 | ○ | ○ | ○ | | 97 |
| Example 12 | ○ | ○ | ○ | | 98 |
| Example 13 | ○ | ○ | ○ | | 98 |
| Example 14 | ○ | ○ | ○ | | 98 |
| Example 15 | ○ | — | — | ○ | 97 |
| Comp. Example 2 | ○ | ○ | ○ | | 98 |
| Comp. Example 3 | — | — | — | | — |
| Comp. Example 4 | ○ | ○ | ○ | | 97 |
| Comp. Example 5 | ○ | ○ | ○ | | 98 |

The fogging, definition, and gradation were visually evaluated by employing a test pattern. The results were evaluated by the following criteria.

○: slightly better than the standard

◎: much better

The transfer efficiency was represented by a value determined by the following method of measuring the transfer efficiency.

(Method of measuring the transfer efficiency)

Employing a commercially available printer and copying machine, a solid image (100 mm long and 20 mm wide) was developed and the printer and copying machine were stopped when the solid image on the photosensitive material passed through the transferring portion by 50%. Then, the image on the photosensitive material after transferring the non-transferred image (solid) was completely peeled off by a tape (30 mm×20 mm) and the amount of the toner of the non-transferred image and the amount of the toner after transferring were measured. The transfer efficiency (%) is calculated by the following equation.

$$\text{Transfer efficiency} = 100 - ((\text{amount of toner after transferring})/(\text{amount of toner of non-transferred image})) \times 100$$

(Method of evaluating OHP sharpness)

A non-fixed image from a color toner was formed on an OHP sheet and the non-fixed image was fixed by a separately prepared fixing tester. The OHP sheet was fixed by passing through a heat roller (oilless type) RICOH IMAGIO DA-250 at a heat roller temperature of 160° C. and a speed of 90 mm/second. A black-printed OHP sheet was placed on the OHP sheet made by the above procedure and was projected on a screen by an overhead projector, and then the sharpness of letters was visually observed. The results were evaluated by the following criteria.

○: sharp letters x: blurry letters

It was confirmed from the results shown in Table 11 that the powdered toners of the Examples of the present invention are superior in fogging, definition, gradation, and transfer efficiency. With respect to the OHP transparency, it was confirmed that the letters are sharp in any of the Examples evaluated.

With respect to the powdered toners of the Examples, each of the toners was mixed with a silicone-coated ferrite carrier (particle diameter of 80 μm) so that the toner concentration became 3% by weight, and the image was formed by employing a commercially available non-magnetic single-component system printer. As a result, a good image was obtained.

With respect to the toners of the Examples and Comparative Examples, a heat-resistant blocking test was performed at 50° C. for three days. As a result, no agglomeration was observed in any of the toners.

Example 16

(Synthesis Example of styrene-methacrylic resin)

200 parts of methyl ethyl ketone were charged in a reaction vessel and heated to 80° C. Then, a mixture of 23 parts of acrylic acid, 180 parts of styrene, 54 parts of methyl methacrylate, 43 parts of 2-ethylhexyl acrylate, and 2.2 parts of "PERBUTYL 0" (produced by NOF Corporation) was added dropwise for two hours. After the completion of the dropwise addition, 0.6 parts of PERBUTYL 0 were added to the reaction solution every four hours, and the reaction was continued at 80° C. for 24 hours to obtain a resin. This resin was a non-crosslinked resin having these physical properties: acid value, 60; Tg, 70° C.; and weight-average molecular weight, 50,000.

(Preparation Examples of microparticles containing positive charge control agent)

90 parts of the styrene-methacrylic resin were dissolved in 122 parts of MEK (methyl ethyl ketone) and 111 parts of THF (tetrahydrofuran) were added, and, furthermore, 102 parts of an aqueous 1N sodium hydroxide solution, and 10 parts of "BONTORON N-07" (produced by Orient Chemical) were added, followed by mixing. 2160 parts of water were added in a single portion while stirring, thereby granulating the microparticles (II) containing a positive charge control agent. Then, MEK and THF were distilled by vacuum distillation to obtain a water dispersion (solid content: 5% by weight) of microparticles (II).

(Preparation Example of positive-charge toner)

20 parts of the water dispersion of the microparticles (II) obtained above and 14.4 parts of an aqueous 1 wt % calcium chloride solution were added to 500 parts of the water dispersion of colored particles (I) (solid content: 100 parts) obtained in Example 1 after removing the solvent, followed by sufficient stirring. Subsequently, the pH was adjusted to 2.5 by adding dropwise an aqueous 0.1N hydrochloric acid solution while stirring, thereby depositing the microparticles (II) on the surface of the colored particles (I). After filtration and washing with water were repeated, the wet cake was freeze-dried. Employing HENSCHEL MIXER (a stirrer), the resulting dried powder was mixed with stirring under heating conditions at 70° C. and then stabilized by sufficiently fixing the microparticles (II) adhered on the surface. Then, the resultant was classified by an air-flow type classifying machine to obtain toner particles having a volume-average particle diameter of 7.3 μm and an average roundness of 0.982.

The toner particles were embedded into a resin and the resulting sample was cut by a microtome, and then the cross section dyed with ruthenium tetraoxide was observed by a TEM (transmission electron microscope). As a result, the pigment and wax were included in the binder resin and dispersed in the particles nearly uniformly.

Employing HENSCHEL MIXER (a stirrer), 0.5 parts of silica HVK2150 (Clariant) were externally added to 100 parts of the toner particles to obtain a positive charge powdered toner.

(Physical properties of positive-charge toner)

Tg of the toner was 60° C., Tfb under a load of 10 kg was 117° C., T1/2 was 149° C., and Tend was 158° C.; Tfb under a load of 30 kg was 104° C., T1/2 was 136° C., and Tend was 145° C.; the THF-insoluble fraction was 3.6%, and T1/2 (T)≧T1/2 (R).

(Image formation test of positive-charge toner)

With respect to the developer obtained by mixing 3 parts of a positive-charge powdered toner with 100 parts of a silicone resin-coated ferrite carrier (average particle diameter: 80 μm), the image was formed by employing a commercially available copying machine (Z-52 produced by Sharp Co.), and then the fogging, definition, gradation, and image density were evaluated. As a result, a good image was obtained.

(Fixation properties test of positive-charge toner and results)

The non-fixed printed papers obtained by the above copying machine were fixed by passing through a heat roller (oilless type) RICOH IMAGIO DA-250 (printer) at a speed of 90 mm/second, and then cellophane tape was applied on the image after fixation. The surface temperature range of the heat roller when the ID (image density) after peeling was 90% or more of the original ID and an offset did not occur is defined as the "fixation temperature". As a result, the fixation temperature was within a range of 116–210° C.

What is claimed is:

1. A toner for electrostatic image development, comprising at least a binder resin and a colorant, said binder resin being made of a polyester resin, wherein the flow beginning temperature Tfb of the toner, as measured by a constant load extrusion capillary rheometer with a load of 30 kg/cm$^2$, is 90° C. or higher and 120° C. or lower, the T1/2 temperature exceeds 120° C. and is 160° C. or lower, and the flow ending temperature Tend is 130° C. or higher and 170° C. or lower, and wherein said toner has a spherical or generally spherical shape having an average roundness (the average value of roundness is defined by (the perimeter of a circle having the same area as that of a projected area of the particles)/(the perimeter of a projected image of the particles)) of 0.97 or more, wherein said binder resin is a mixture of:

(A) a straight-chained polyester resin in which the T1/2 temperature, as measured by the constant load extrusion capillary rheometer, is 80° C. or higher and 120° C. or lower, and the glass transition temperature Tg is 40° C. or higher and 75° C. or lower, and (B) a crosslinked polyester resin in which the T1/2 temperature, as measured by the constant load extrusion capillary rheometer, exceeds 120° C. and is 210° C. or lower, and the glass transition temperature Tg is 40° C. or higher and 75° C. or lower, and wherein a weight ratio of said resin (A) to said resin (B), (A)/(B), is within a range of 20/80–80/20, and wherein said toner satisfies the relationship:

$$20^\circ\ \mathrm{C.} \leqq T1/2(B) - T1/2(A) \leqq 120^\circ\ \mathrm{C.}$$

wherein T1/2(A) and T1/2(B) respectively represent the T1/2 temperature of said resin (A) and said resin (B).

2. A toner for electrostatic image development in accordance with claim 1, wherein the content of a tetrahydrofuran-insoluble fraction of said binder resin in the toner is within a range of 0.2–20% by weight.

3. A toner for electrostatic image development in accordance with claim 1, which satisfies the relationship:

$$T1/2(\mathrm{toner}) \geqq T1/2(\mathrm{resin})$$

where T1/2 (toner) and T1/2 (resin) respectively represent the T1/2 temperatures as measured by the constant load extrusion capillary rheometer of said toner and said polyester resin used as said binder resin.

4. A toner for electrostatic image development in accordance with claim 1, wherein the weight-average molecular weight, as measured by gel permeation chromatography of a tetrahydrofuran-soluble fraction of said binder resin in said toner, is 30,000 or more, the (weight-average molecular weight)/(number-average molecular weight) is 12 or more, the area ratio of a molecular weight of 600,000 or more is 0.5% or more, and the area ratio of a molecular weight of 10,000 or less is within a range of 20–80%.

5. A toner for electrostatic image development in accordance with claim 1, wherein said binder resin has a carboxyl group, and the acid value of said binder resin is within a range of 1–30 KOHmg/g.

6. A toner for electrostatic image development in accordance with claim 1, further comprising a releasing agent.

7. A toner for electrostatic image development in accordance with claim 6, wherein said releasing agent comprises a synthetic ester and/or a natural ester wax.

8. A toner for electrostatic image development in accordance with claim 1, further comprising a positive charge control agent.

9. A method of producing the toner for electrostatic image development of claim 1, which comprises a step of mixing a mixture of said binder resin made of a polyester resin, wherein said polyester resin has a carboxyl group, said colorant, and a releasing agent with an aqueous medium in the presence of a base and emulsifying the admixture (emulsifying step) to prepare a suspension of colored particles (I); and a step of separating said colored particles (I) from said aqueous medium and drying said colored particles.

10. A method of producing the toner for electrostatic image development in accordance with claim 9, wherein the binder resin made of a polyester resin having a carboxyl group, the colorant, and the releasing agent in said mixture are previously dissolved or dispersed in an organic solvent, and said colored particles (I) are produced by further adding a phase inversion accelerator in said emulsifying step.

11. A method of producing the toner for electrostatic image development in accordance with claim 10, wherein said phase inversion accelerator is an alcohol solvent.

12. A method of producing the toner for electrostatic image development in accordance with claim 10, wherein stirring in said emulsifying step is performed by a stirring blade at a peripheral speed within a range of 0.2–5 m/second.

13. A method of producing the toner for electrostatic image development of claim 12, wherein said stirring blade is a max blend blade or a full-zone blade.

14. A method of producing the toner for electrostatic image development in accordance with claim 9, wherein said releasing agent comprises a synthetic ester and/or a natural ester wax.

15. A method of producing the toner for electrostatic image development in accordance with claim 9, wherein in said step of mixing a mixture, the mixture further comprises a positive charge control agent.

16. A method of producing the toner for electrostatic image development in accordance with claim 9, which comprises adding a suspension of microparticles (II), obtained by emulsifying a mixture of a positive charge control agent and a resin capable of being provided with self-water dispersibility and/or water solubility by neutralization of the resin with an aqueous medium in the presence of a neutralizer, to said suspension of said colored particles (I) to yield a mixture of suspensions; adding to the mixture of suspensions a compound having the reverse polarity as compared with said neutralizer to form microparticles (III) in which microparticles (II) are deposited on the surface of said colored particles (I); separating said microparticles (III) from said aqueous medium; and drying said microparticles (III).

17. A method of producing the toner for electrostatic image development in accordance with claim 9, wherein the colorant and releasing agent used in the emulsifying step during the preparation of the suspension of said colored particles (I) are previously kneaded and dispersed by a wet process.

18. The toner for electrostatic image development in accordance with claim 1, wherein said toner has a structure wherein the colorant is included in the toner particles and is prevented from being exposed on the surface of the toner particles.

19. The toner for electrostatic image development in accordance with claim 1, wherein said toner has a structure wherein the colorant and releasing agent are included in the toner particles and prevented from being exposed on the surface of the toner particles.

20. A method of producing the toner for electrostatic image development of claim 1, which comprises a step of mixing a mixture of said binder resin made of a polyester resin, said colorant, and a releasing agent with an aqueous medium in the presence of a base and emulsifying the admixture (emulsifying step) to prepare a suspension of colored particles (I); and a step of separating said colored particles (I) from said aqueous medium and drying said colored particles, wherein the acid value of said binder resin made of a polyester resin is within a range of 1–30 KOH mg/g.

* * * * *